US006808459B2

(12) United States Patent
Checketts

(10) Patent No.: US 6,808,459 B2
(45) Date of Patent: Oct. 26, 2004

(54) AMUSEMENT RIDE WITH CABLE-LAUNCHED CARRIER

(76) Inventor: Stanley J. Checketts, 900 E. Canyon Rd., Providence, UT (US) 84332

( * ) Notice: Subject to any disclaimer, the term of this patent is extended or adjusted under 35 U.S.C. 154(b) by 0 days.

(21) Appl. No.: 09/923,269

(22) Filed: Aug. 3, 2001

(65) Prior Publication Data

US 2003/0027646 A1 Feb. 6, 2003

(51) Int. Cl.[7] ..... A63G 9/16
(52) U.S. Cl. ..... 472/118; 472/131; 472/133
(58) Field of Search ..... 472/2, 49, 50, 472/131, 133, 136

(56) References Cited

U.S. PATENT DOCUMENTS 4,973,042 A * 11/1990 Klopf et al. ..... 104/79
5,421,783 A * 6/1995 Kockelman et al. ..... 472/131
5,649,866 A * 7/1997 Balwanz ..... 472/118
5,665,002 A * 9/1997 Balwanz ..... 472/118
5,704,841 A * 1/1998 Checketts ..... 472/131
5,782,699 A * 7/1998 Harrap ..... 472/118
5,810,671 A * 9/1998 Balwanz et al. ..... 472/118
5,957,779 A * 9/1999 Larson ..... 472/131
6,083,111 A * 7/2000 Moser et al. ..... 472/131
6,319,140 B1 * 11/2001 Mirfin et al. ..... 472/130

* cited by examiner

*Primary Examiner*—Kien Nguyen
(74) *Attorney, Agent, or Firm*—Fehr Law Firm; Thompson E. Fehr

(57) ABSTRACT

An amusement ride with cable-launched carrier having one or more towers with the upper portion of at least one such tower being flexible. Each tower supports a cable. Attached to the first end of such cable is a means for propelling a carrier that is attached to the second end of each cable. The means for propelling is a high-speed winch, a fluid-powered cylinder having a continuous cable, or a fluid-powered cylinder having a non-continuous cable. Optionally, a controllably rotatable seat can be attached to the carrier; a harness connected to a serrated rod that slides into a biased block holds each participant to the seat; and a spring, weight, or pressurizable cylinder prevents each cable from becoming slack.

43 Claims, 17 Drawing Sheets

AMUSEMENT RIDE WITH CABLE-LAUNCHED CARRIER

BACKGROUND OF THE INVENTION

1. Field of the Invention

This invention relates to an amusement ride that uses cables to elevate a carrier for one or more participants between a multitude of towers.

2. Description of the Related Art

U.S. Pat. No. 5,632,686 employs a multitude of towers and cables to elevate a carrier for participants. There is no indication, however, that at least the top portion of the towers would be flexible. In fact, the arches shown in FIG. 4 between adjacent towers suggests that there is no such flexibility.

Several patents, e.g., U.S. Pat. Nos. 5,421,783; 5,649,866; and 5,810,671 have a passenger carrier that is accelerated upward by bungee cords and can relatively freely swing about the ends of such cords. U.S. Pat. No. 5,649,866 uses three towers; U.S. Pat. Nos. 5,421,783 and 5,810,671 utilize three towers. No mention is made of any flexibility in the towers of these patents. The lattice construction shown in the drawings of U.S. Pat. Nos. 5,649,866 and 5,810,671 imply that there would be no such flexibility. Indeed, lines 56 through 56 in column 2 of U.S. Pat. No. 5,649,866 refer to the towers as "three upstanding, stationary towers"; and lines 32 through 33 in column 2 of U.S. Pat. No. 5,8180,671 use the descriptive terminology "pair of spaced, stationary towers." The relatively short height of the towers shown in the drawings for U.S. Pat. No. 5,421,783 provides a similar implication. And, in fact, line 11 in column 6 of that patent describes the towers as being "rigid structures."

The passenger carrier in U.S. Pat. Nos. 5,421,783; 5,649,866; and 5,810,671 that is accelerated upward by bungee cords can relatively freely swing about the ends of such cords. There is, however, no controlled rotation of the carrier; U.S. Pat. No. 5,810,671, in lines 2 through 5 of column 7, merely indicates that, by "shifting their weight" participants can cause the carrier of the invention to commence rolling.

U.S. Pat. No. 6,083,111 does involve controlled rotation of a passenger chair (also termed a "support") for an amusement ride. The degree of rotation is, however, purposefully limited; the limited rotation that is possible apparently occurs only over a restricted, fixed portion of a course upon a tower; and only downward movement occurs when the chair has been rotated from its initial substantially vertical position.

Lines 31 through 37 in column 2 of U.S. Pat. No. 6,083,111 explain, "The passenger support, together with the passenger, is tilted forward into a falling orientation which is at a predetermined tilt-angle to the pre-fall orientation. The passenger support, together with the passenger, is dropped or propelled from the drop position to a lower position while the passenger support and the passenger are in the forward tilted falling orientation . . . "

Lines 3 and 4 in column 3 further clarify, "for safety reasons, the tilt-angle of the passenger and the passenger support is limited . . . "

U.S. Pat. No. 6,083,111 continues, in lines 26 through 28 of column 3, by asserting, "A travel course for the carriage is established by engaging a guide that is connected to the carriage upon an elongate rail or track that is coupled to an elevating tower."

Lines 23 through 25, 39 through 42, and 46 through 49 of column 3 state, "The degree of tilt between the pre-fall orientation 92 and the falling orientation 95 is predetermined and restricted . . . When the latching mechanism 40 is released, the passenger support 22 is permitted to tilt or be tilted from the pre-fall orientation 92 toward and into the falling orientation 95 . . . Alternatively, the tilting action can be induced by an operating mechanism B43B which in the described embodiment is a rotary motor and may be exemplarily electromechanical, hydraulic or other suitable configuration."

Lines 39 through 46 and 55 through 57 of column 6 consistently provide, "Upon reaching the drop position 70, the passenger support 22 is permitted to tilt, or is tilted from the upright and sitting pre-fall orientation 92 to the tilted falling orientation 95. To accomplish such tilting, the latching mechanism 40 is released and the passenger 55 is either motored to the tilted position using the operating mechanism 43 or the support 22 is simply allowed to drop to the tilted position and falling orientation 95 under the passenger's 55 own weight . . . . The tilting action is accommodated by the pivot connection 37 and is limited either by the operating mechanism 43 or appropriate stops." Then line 67 of column 3 through line 2 of column 7 declares, "Either simultaneously or shortly thereafter, the carriage 34 begins to drop over a falling travel distance 73."

Finally, with respect to U.S. Pat. No. 6,083,111, lines 53 through 56 in column 7 observe, "The maximum safe tilt angle 98 is experimentally determined and then the actual tilt angle 98 is restricted within a range between that determined angle and the upright position."

Furthermore, none of the preceding patents has a restraint system for the participant which employs a harness releasably held in place through the insertion of a serrated rod into an aperture of a directionally biased block.

U.S. Pat. No. 5,632,686 does not discuss a restraint system. Lines 20 and 21 of column 7 in U.S. Pat. No. 5,421,783 simply note, " . . . each rider is strapped in with dual shoulder belts and a standard lap belt." U.S. Pat. No. 5,649,866, in lines 58 through 61 of column 3, and U.S. Pat. No. 5,810,671, in lines 24 through 27, utilize identical language: "Associated with each seat 58 is a five-point harness assembly 60 for securing an individual within the seat 58 when an individual is seated therein." And U.S. Pat. No. 6,083,111, in lines 6 through 17 of column 5, provides, "The carriage 34 has a passenger support or car 22 mounted thereupon. The passenger support 22 includes a chair-type structure upon which the passenger 55 directly rests. The chair includes a headrest, restraint 31 for retaining the passenger 55 safely in the support 22 throughout the ride's 10 cycle. The restraint 31 is pivotally connected at an upper portion 28 of the passenger support 22. Supplemental restraints may also be included as required or desired. The several restraints however, are of conventional design and well-known in the amusement ride arts."

And none of the preceding patents includes a device for maintaining tension in a cable which assists in providing the propulsive force to the carrier for the participant or participants on an amusement ride.

Examples of patents which apply to fluid-powered cylinders associated with cables for powring amusement rides are U.S. Pat. Nos. 5,632,686; 5,704,841; 5,893,802; 6,001,022; and 6,176,788.

SUMMARY OF THE INVENTION

The present invention utilizes cables suspended from a multitude of towers, preferably an odd number of towers and most preferably three towers, to raise a carrier for passengers.

Any means for causing the end of a cable attached to the carrier to move in a desired direction that is known in the art may be employed. This includes, but is not necessarily limited to, a high-speed winch or a fluid-powered cylinder. The propulsive force may be applied to the cable either at the end of the cable other than the end which is attached to the carrier or, preferably, at a point intermediate between the ends of the cable.

At least the upper portion at least one of the towers and, preferably, all of the towers is flexible. Movement of the towers in response to acceleration of the carrier cushions the carrier and, consequently, participants on the carrier.

Preferably, but not necessarily, the carrier has one or more controllably rotatable seats.

Also preferably, but not necessarily, participant are held to their seats with harnesses attached to one or more serrated rods, wherein each serrated rod is inserted into an aperture of a directionally biased block.

And, optionally, a device for maintaining tension in a cable is employed for the cables.

DESCRIPTION OF THE PREFERRED EMBODIMENT

Figure 1:
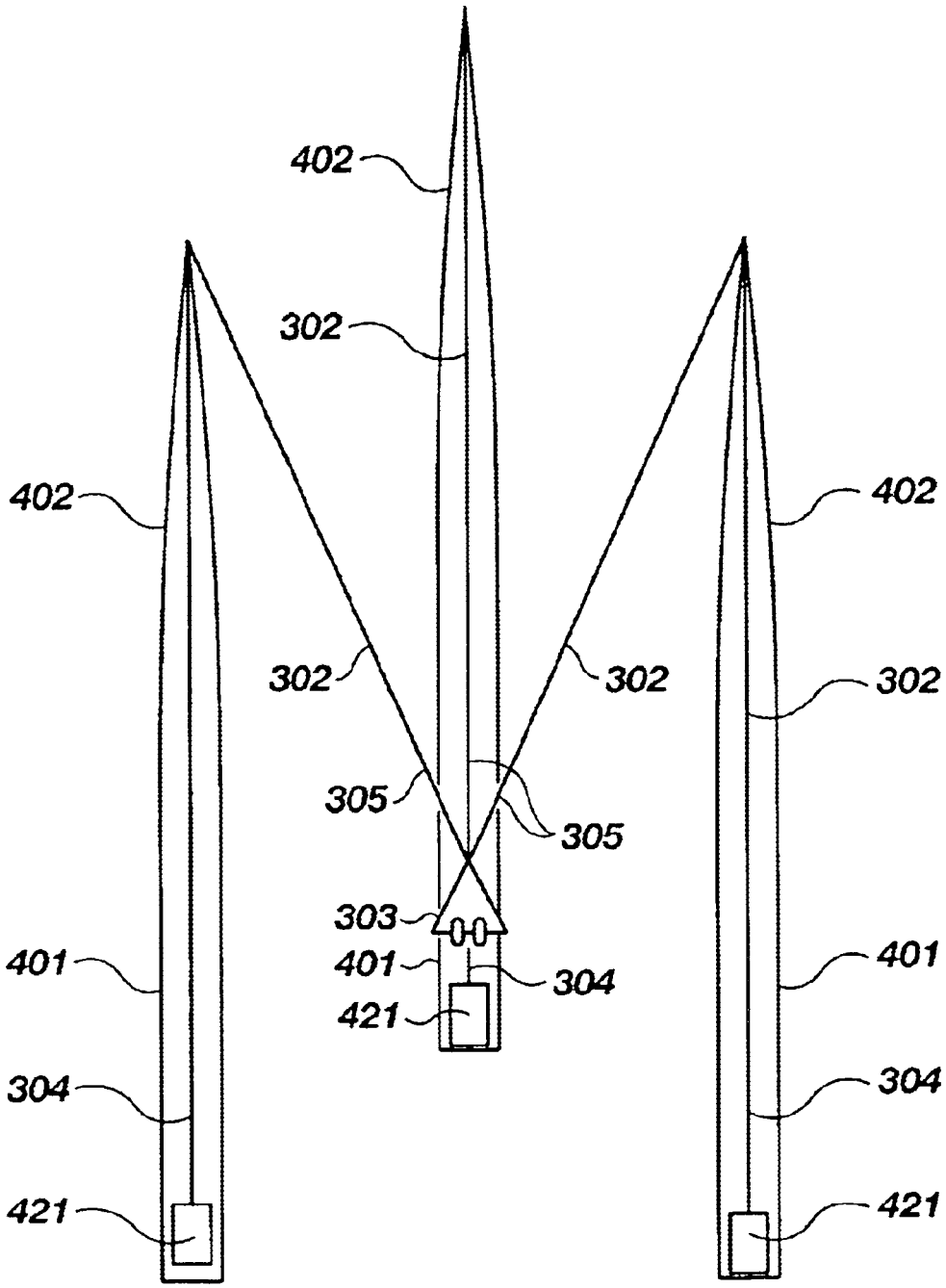
FIG. 1 depicts the Amusement Ride with Cable-launched Carrier with a means for propelling a carrier attached to a first end of cables from towers.
Figure 2:
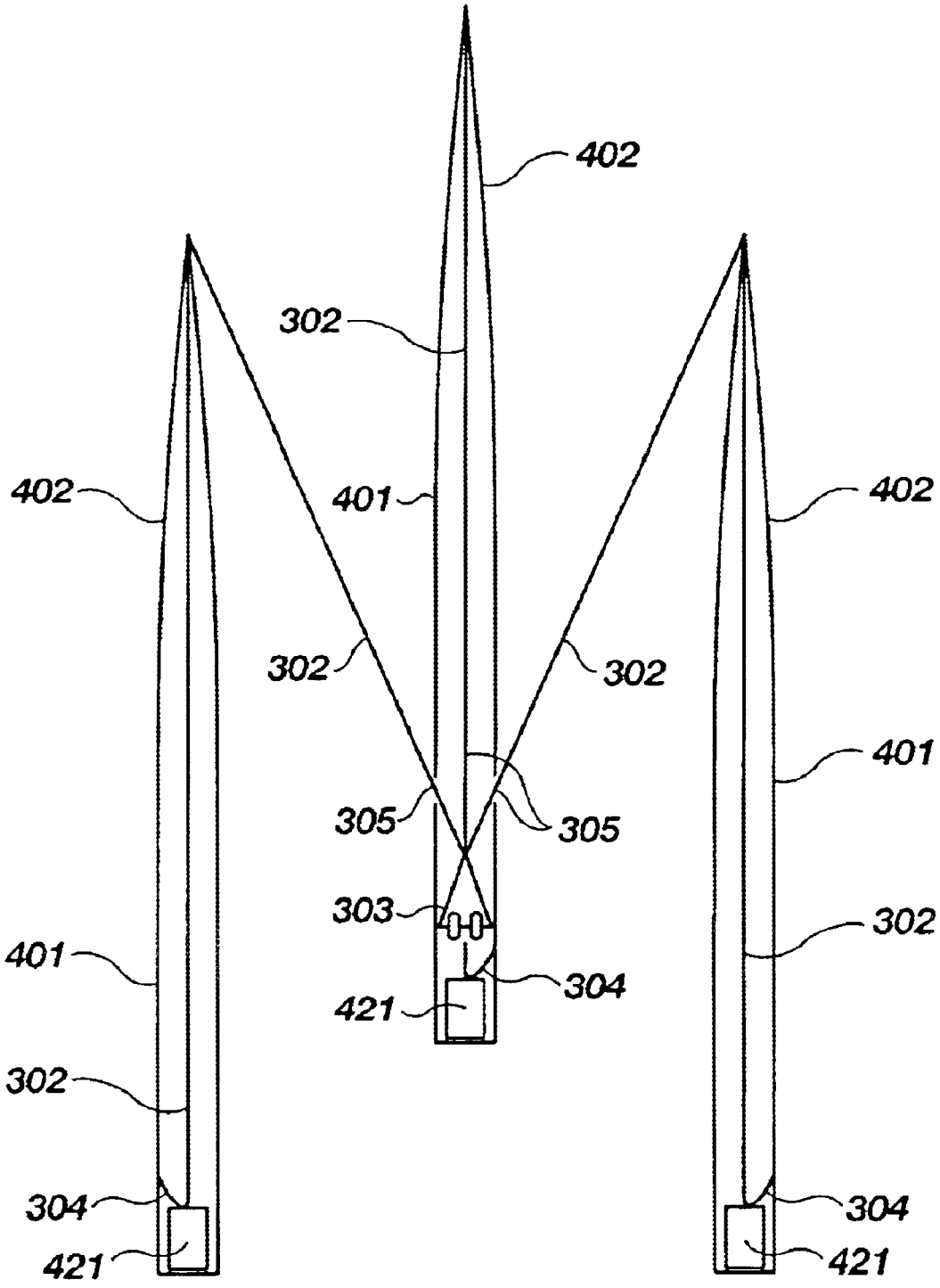
FIG. 2 illustrates the Amusement Ride with Cable-launched Carrier with a means for propelling a carrier connected at an intermediate point on each cable.

As its name implies, the Amusement Ride with Cable-launched Carrier has, as illustrated in FIG. 1 and FIG. 2, a cable 302 suspended from a tower 401. Preferably, there are a multitude of cables 302 and towers 401, more preferably and odd number, and most preferably three.

At least the upper portion 402 of at least one tower 401 and, preferably of all the towers 401, is flexible.

A means 421 for propelling a carrier 303 for one or more participants is attached either to a first end 304 of each cable 302 or at an intermediate point between the first end 304 and the second end 305 of a cable 302. The second end 305 of each cable 302 is connected to the carrier 303.

This means can be any mechanism that is well known in the art for propelling a carrier 303 of an amusement ride. For example, it can be a high-speed winch, a fluid-powered cylinder having a continuous cable, or a fluid-powered cylinder having a non-continuous cable.

Figure 3:
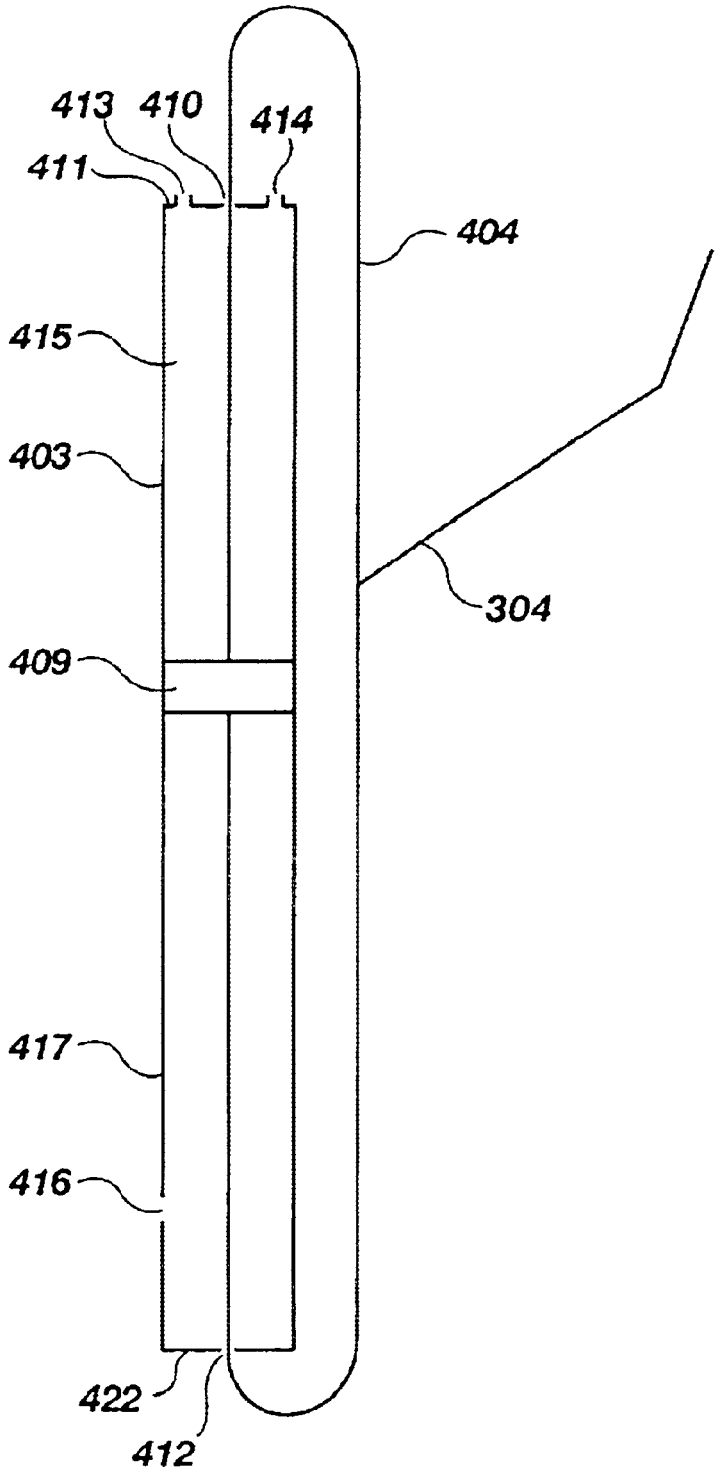
FIG. 3 shows the connection of a fluid-powered cylinder having a continuous cable to the first end of a cable.

FIG. 3 shows a fluid-powered cylinder 403 having a continuous cable 404 attached to the first end 304 of the cable 302 which propels the carrier 303. The first end 304 is merely connected to the continuous cable 404.

Figure 4:
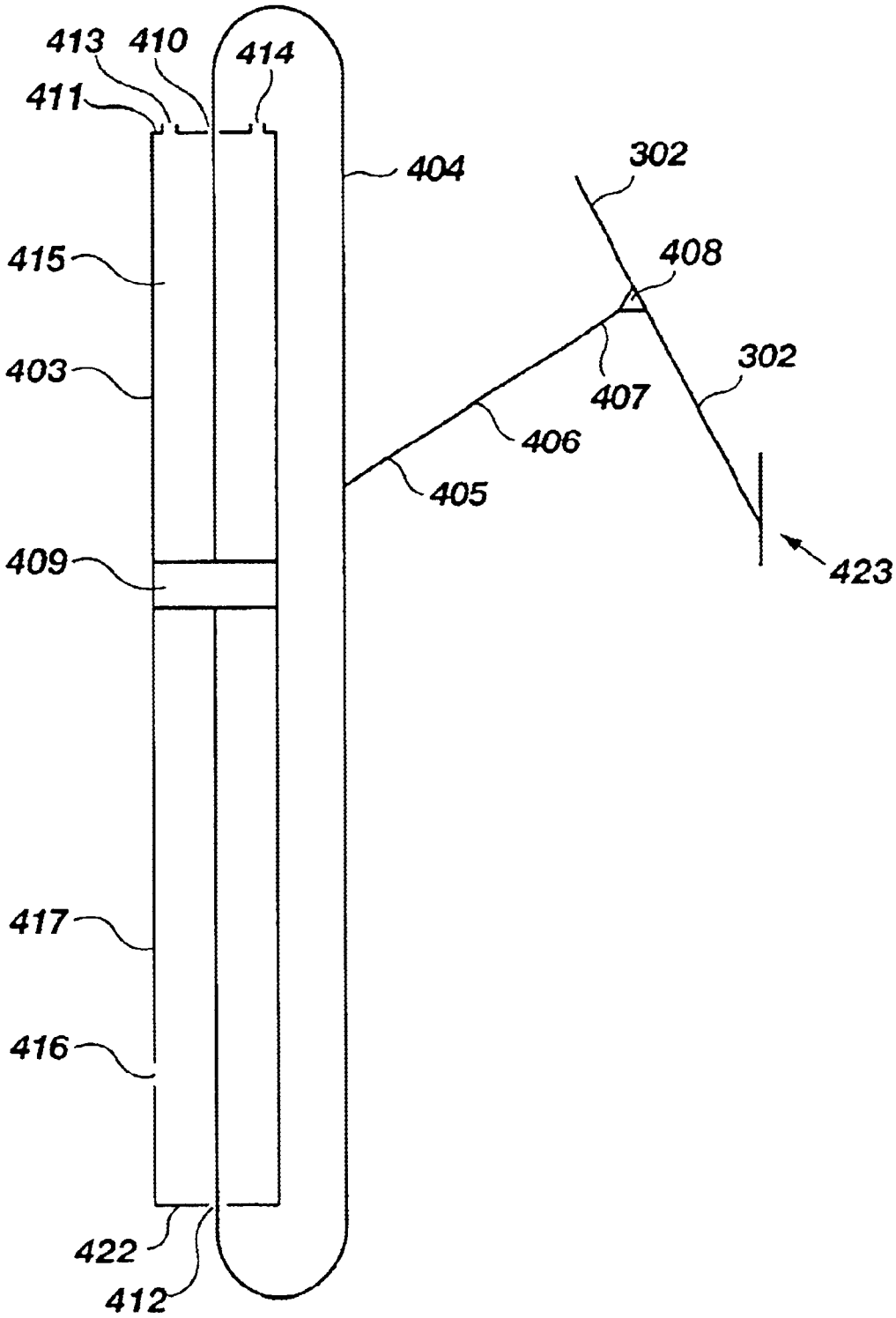
FIG. 4 portrays the attachment of a fluid-powered cylinder having a continuous cable at an intermediate point on a cable.

The continuous cable 404 can, alternatively, be connected at an intermediate point of the cable 302, as portrayed in FIG. 4. In this embodiment, a first end 405 of a transfer cable 406 is connected to the continuous cable 404; and a second end 407 of the transfer cable 406 is connected to a slide 408 through which the cable 302 can substantially freely move. The first end 304 of the cable 302 is attached to any structure 423 which will hold such first end 304 substantially stationary; and the slide 408 is preferably, but not necessarily, a pulley.

Figure 5:
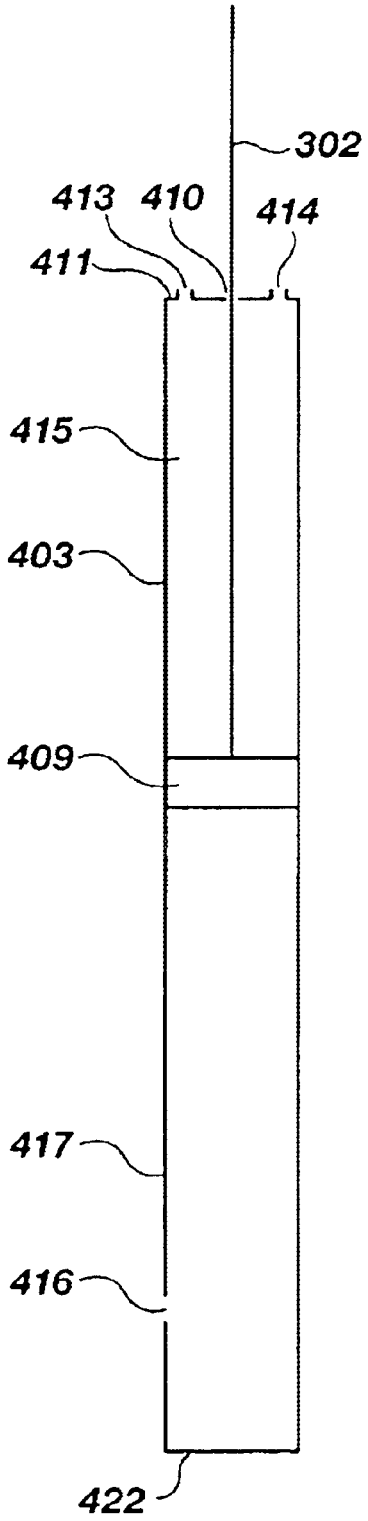
FIG. 5 demonstrates the connection a fluid-powered cylinder having a non-continuous cable to the first end of a cable.

A fluid-powered cylinder 403 having a non-continuous cable is attached to the first end of the cable 302 by merely having the first end 304 of the cable 302 connected to a piston 409 slidably mounted within the cylinder 403, as depicted in FIG. 5.

Figure 6:
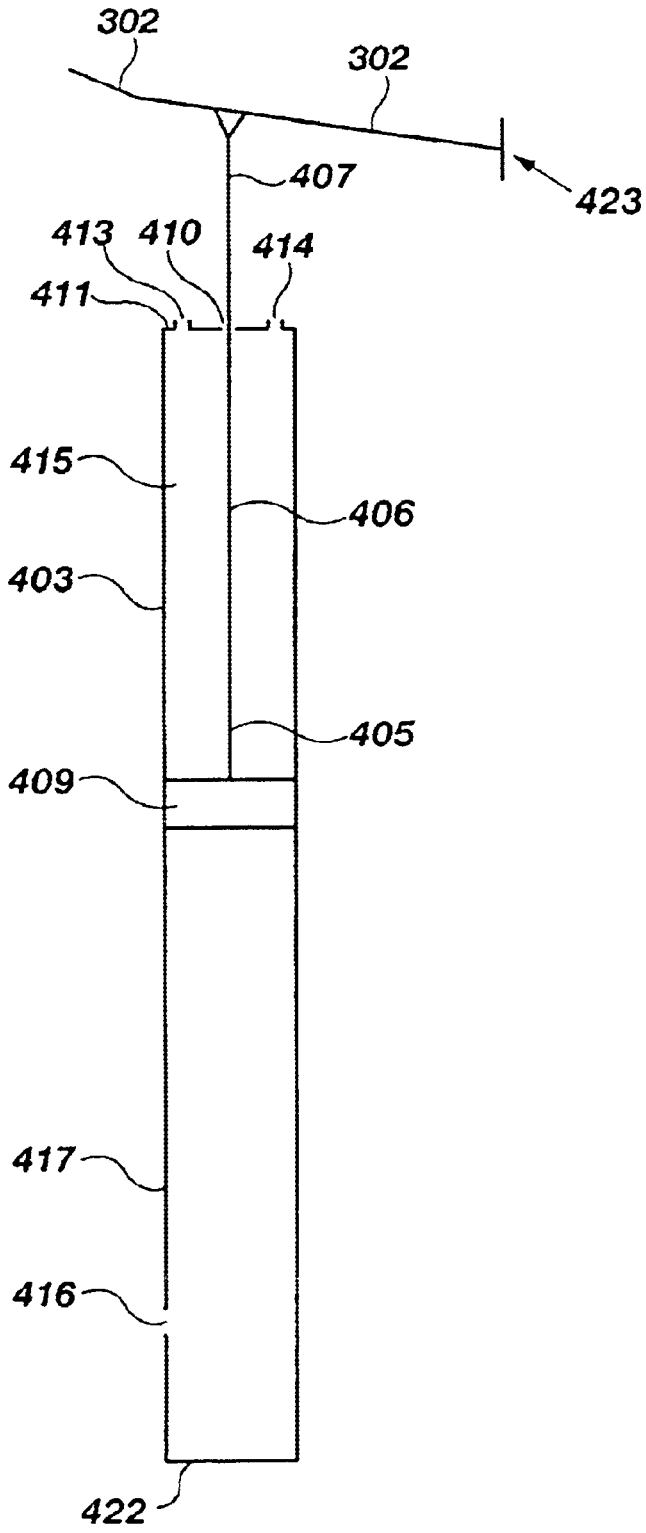
FIG. 6 is a view showing the attachment of a fluid-powered cylinder having a continuous cable at an intermediate point on a cable.
Figure 7:
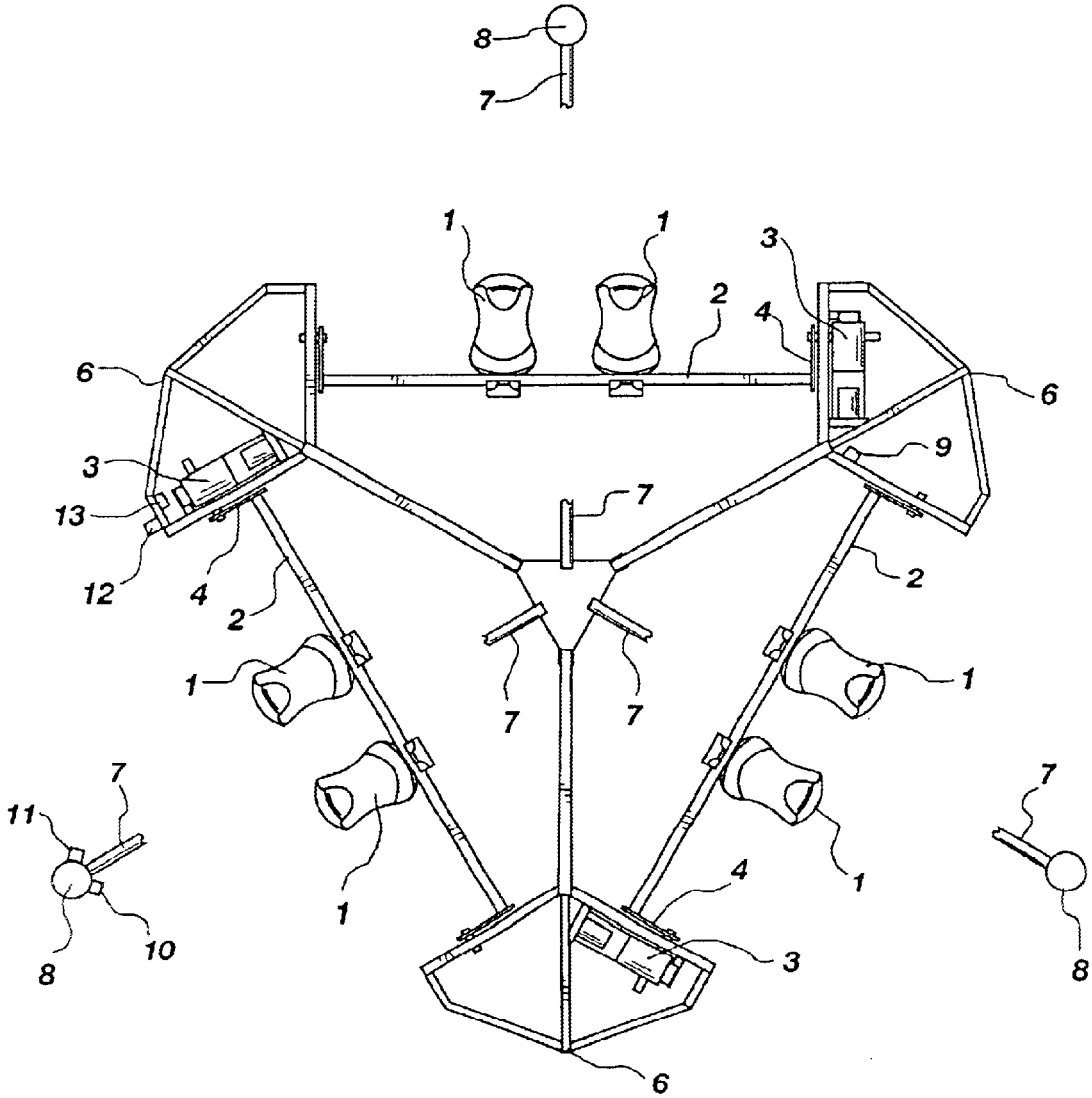
FIG. 7 shows a first view of the Controllably Rotatable Seat.
Figure 8:
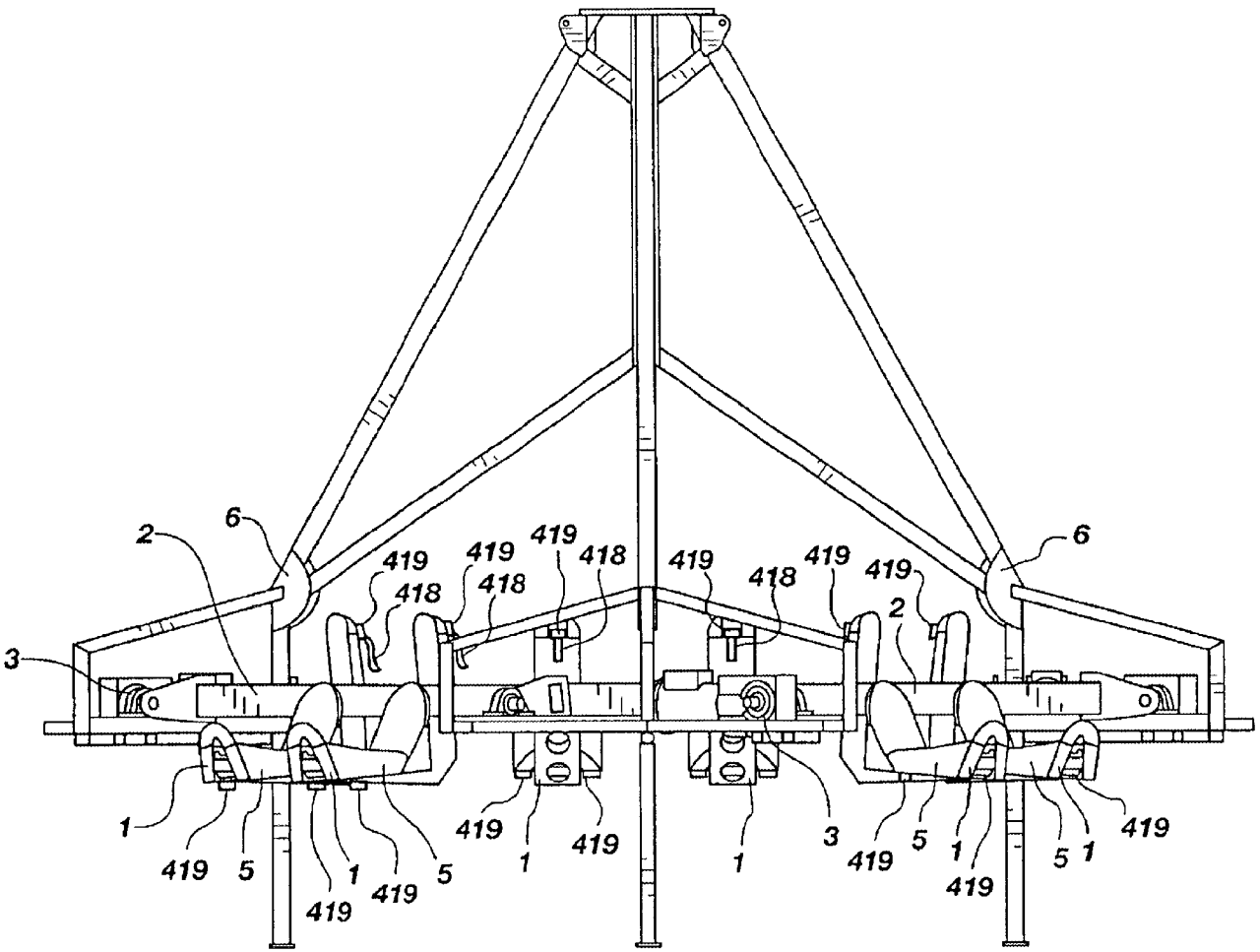
FIG. 8 provides an alternate view of the Controllably Rotatable Seat.
Figure 9:
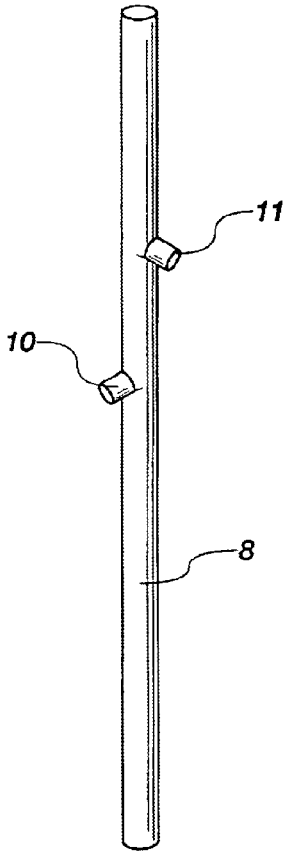
FIG. 9 depicts a target on a tower to be detected by a sensor associated with the Controllably Rotatable Seat.
Figure 10:
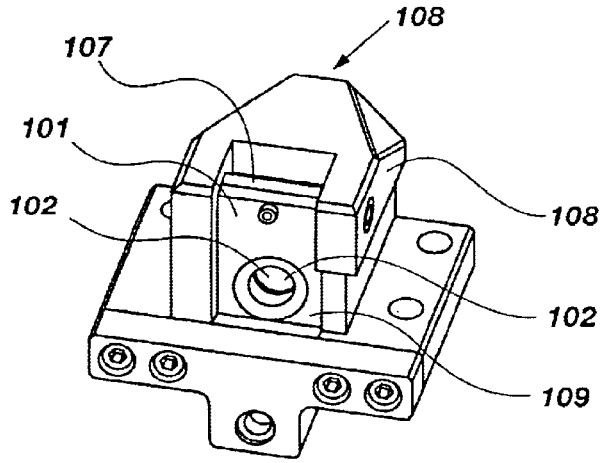
FIG. 10 provides a normal view of the Locking Apparatus.
Figure 11:
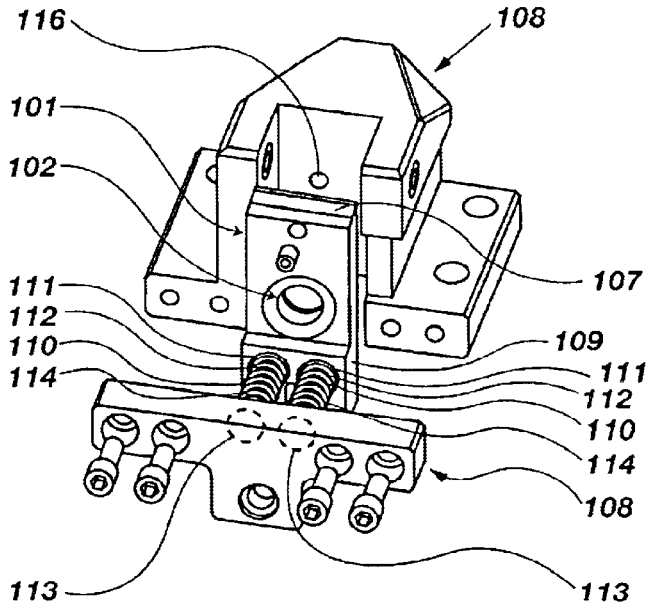
FIG. 11 is an exploded view of the Locking Apparatus.
Figure 12:
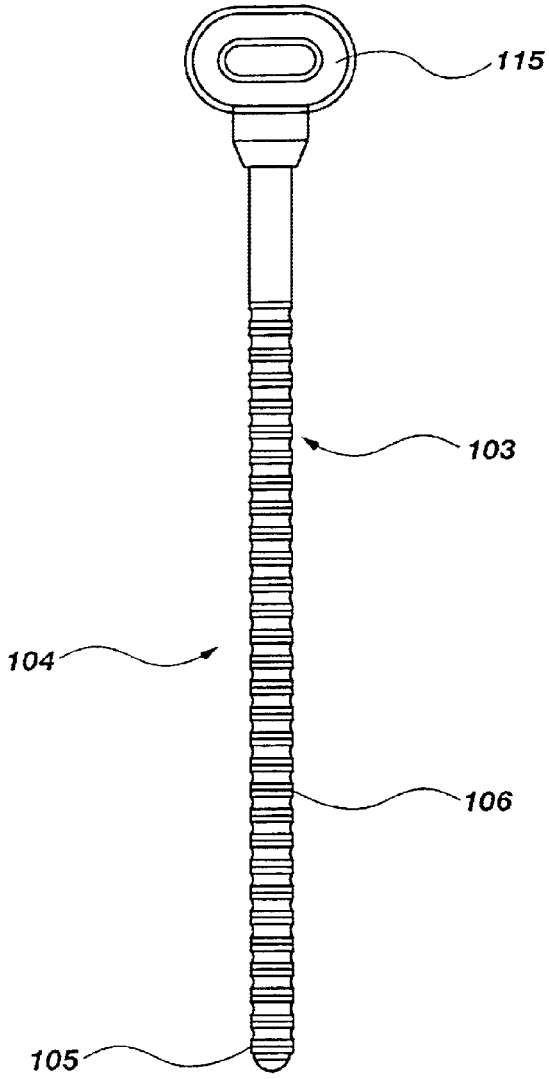
FIG. 12 shows a rod having its second end in the shape of a loop.
Figure 13:
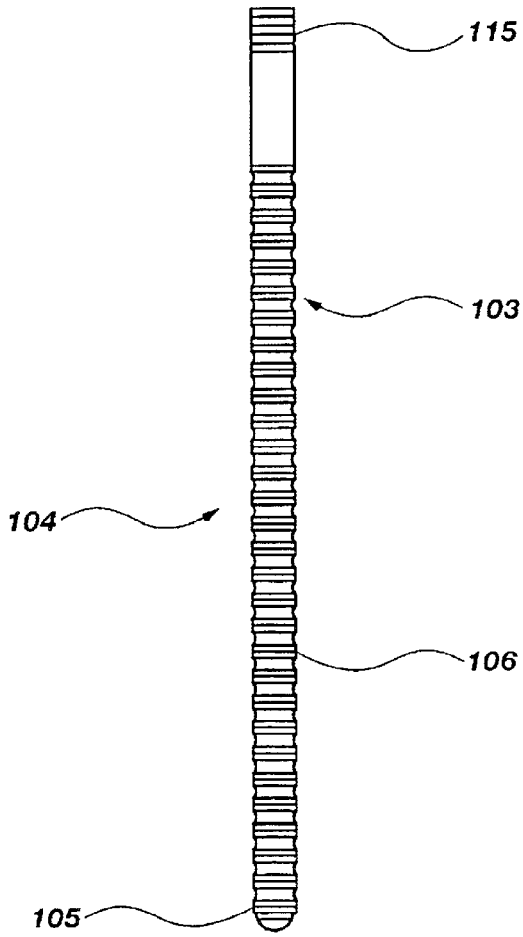
FIG. 13 illustrates a rod having screw threads on its second end.

When a fluid-powered cylinder 403 having a non-continuous cable is connected at an intermediate point of the cable 302, this is done exactly as in the case of the continuous cable except that the first end 405 of the transfer cable 406 is attached to the piston 409, as portrayed in FIG. 6. And, with respect to the embodiments of the fluid-powered cylinder 403 discussed so far, the term transfer cable 406 includes not only a flexible cable, but also a rod. Moreover, the term cable 302 for any portion of the cable 302 which enters the fluid-powered cylinder 403 also, but not preferably, includes a non-flexible structure such as a rod.

Each fluid-powered cylinder 403 has an aperture 410 in a first end 411 of said cylinder 403 through which the cable 302, 404, or 406 passes. The fluid-powered cylinder 403 having a continuous cable also has an aperture 412 in a second end 422 of the cylinder 403 through which the cable 404 passes before connecting to the piston 409. The second end 422 can actually be either open or closed.

In or near, i.e., closer than the piston 409 will ever be, to the first end 411 is a valve 413 for injecting the fluid to propel the piston 409 and, consequently, the carrier 303. Either this valve 413 or a separate descent valve 414 communicating with the interior 415 of the cylinder 403 can, when necessary, be utilized to reduce fluid in order to facilitate the return of the piston 409 and, consequently, the carrier 303, to its original position. Optionally, the cylinder 403 may contain an aperture or valve 416 in the side 417 of the cylinder 403 to reduce pressure and thereby facilitate movement of the piston 409 before it reaches the aperture or valve 416 as well as reducing pressure after the piston 409 has passed the aperture or valve 416 in order to assure that the piston 409 and, consequently, the carrier 303 is not propelled too forcefully.

A controllably rotatable seat has a seat 1 attached to an arm 2 that is rotated by a means for rotating 3 which is preferably an electric motor but which can be pneumatics, hydraulics, or any other mechanism that is well known in the art for producing rotation. (The term "seat" is used herein to mean either a single seat or a group of two or more seats.)

Preferably, but not necessarily, a lever arm 4 connects the arm 2 to the means for rotating 3 so that the point of rotation of the means for rotating 3 will be substantially aligned with the center of gravity of a participant sitting on the seat 1.

Also preferably, but not necessarily, the lower portion 5 of the seat 1 is a saddle seat, i.e., it is formed in substantially the same shape as a saddle for a horse, in order to cause the participant to feel exposed to excitement.

The arm 2 and, consequently, the seat 1 can preferably, but not necessarily, rotate at least ninety degrees.

Preferably, but not necessarily, there would also be a means for retaining the participant to the seat 1, such as a harness.

The arm 2 and the means for rotating 3, as well as the lever arm 4 when employed, are attached to the carrier 303. Attachment of the arm 2, and the lever arm 4 when employed, is a rotatable attachment to the carrier 303.

A timer 9 communicating with the means for rotating 3 can be programmed with the time to commence rotation and the time to begin rotating the seat 1 to its original orientation.

Alternatively, a target 10 can be located on a tower 401 at a point where rotation is desired to commence as the seat 1 passes the target 10, and a second target 11 can be placed on a tower 401 at a point where it is desired to have the seat 1 start rotating back to its original orientation. A sensor 12 capable of detecting the targets 10, 11 would be mounted on the carrier 303 and communicate either directly or through a preferably, but not necessarily, programmable, logic unit 13 such as a computer with the means for rotating 3. Optionally, only a single target 10 would be employed; and the seat 1 would start rotating as it passed the target 10 going in a first direction and would begin rotating to its original orientation as it passed the target 10 going in the substantially opposite direction.

A device known in the art for measuring distances could also determine the distance between a known elevation (or other position) and the carrier 303. Such device communicates through a, preferably, but not necessarily, programmable, logic unit 13 such as a computer with the means for rotating 3. Initial rotation would commence at a given distance, and rotation back to the original orientation of the seat 1 would begin at another specified distance, with such criteria either set into the logic unit 13 at the factory or, when the logic unit is programmable, programmed into the logic unit 13 by a user. Communication in this embodiment would preferably, but not necessarily, be by digitally encoded radio signals.

Finally, any device well known in the art for measuring the distance a cable 302 moves could function just as does the device for measuring distances discussed in the preceding paragraph.

Also, as discussed above, any device known in the art for measuring speed or acceleration or any other measurable criterion associated with the amusement ride could determine the time for rotation and the time for return of the seat 1 to its original orientation just as discussed for the device for measuring distances.

And, preferably, but not necessarily, the means for retaining the participant to the seat 1 includes a harness 418 attached to a locking apparatus 419.

The locking apparatus has a block 101 containing an aperture 102. The block is attached to the seat 1.

A rod 103 is removably insertable into the aperture 102. The rod 103 is serrated, i.e., the thickness of the rod 103 varies periodically along a portion 104 of the length of the rod 103 beginning near a first end 105 of the rod 103.

The maximum periodic thickness 106 of the rod 103 is less than the minimum diameter of the aperture 102 in the block 101 so that the rod 101 can be inserted into the aperture 102.

Between the center of the aperture 102 and a first end 107 of the block 101, the block is rotatably attached to a support structure 108. The block 101 is biased so that the second end 109 of the block 101 is farther toward the direction from which the rod 103 is intended to be inserted that is the first end 107 of the block 101. Preferably, but not necessarily, such biasing is done between the center of the aperture 102 and a second end 109 of the block 101.

The biasing of the block 101 reduces the minimum diameter of the aperture 102 as projected perpendicular to the longitudinal axis of the rod 103. The projected minimum diameter of the aperture 102 is then less than the periodic maximum diameter 106 of the rod 103 so that pushing the rod 103 into the aperture 102 tends to decrease the biasing, thereby increasing the minimum projected diameter of the aperture 102, until the minimum projected diameter of the aperture 102 exceeds the periodic maximum diameter 106 of the rod 103 so that the rod 103 can enter the aperture 102. Continuing to push the rod 103 enables it to proceed farther into the aperture 102. As the rod 103 is pushed farther into the aperture 102, however, the biasing pushes the edge of the aperture 102 into a portion of the rod 103 between periodic maximum diameters 106. Then attempting to withdraw the rod 103 causes the rod 103 to pull the block 101 and thereby either maintain or increase the biasing, which consequently reduces the projected diameter of the aperture 102 and precludes withdrawal of the rod 103.

Biasing may be accomplished by any device 110, such as a spring that will exert a physical force between the block 101 and the support structure 108. Preferably, but not necessarily, the block 101 contains a first depression 111 to hold a first end 112 of the device 110; and preferably, but not necessarily, the support structure contains a second depression 113 to hold a second end 114 of the device 110.

The second end 115 of the rod 103 is available for connection to a restraining device such as the cloth of a seat belt or a bar and is shaped to accommodate such restraining device. This shape is generally a loop for a seat belt or screw threads for insertion into a bar.

The further the rod 103 is pushed into the block 101, the tighter the restraint will be.

Any means well known in the art for applying a physical force is used to push against or pull the block 101 to reduce the biasing. Such a means may, e.g., be a manually operated rod or lever, a cable attached to the block 101 to pull the block 101, a motor, a hydraulically powered rod to push the block 101, or a pneumatically powered rod to push the block 101.

Finally, a sensor 116 of any type known in the art for indicating the presence of the rod 103 within the block may be utilized. This could, for example, be a contact sensor or a light sensor.

Optionally, the Amusement Ride with Cable-launched Carrier includes a device for maintaining tension in a cable. In some embodiments of such a situation, as will be more fully explained below, the first end 304 of the cable 302 is allowed to move somewhat.

When the propulsive force for the carrier 303 is applied at an intermediate point of the cable 302, in order to reduce slackness in the cable 302 as the carrier 303 approaches its upper vertical limit, a means is employed for applying a pulling force along the cable 302 in the direction away from the carrier 303 to which such cable 302 is attached. This pulling force is applied to the end 304, designated the first end, of the cable 302 other than the end 305, designated the second end, that is connected to the carrier 303. In such a circumstance, the first end 304 of the cable 302 is not connected to a structure 423 which will hold such first end 304 substantially stationary.

Figure 14:
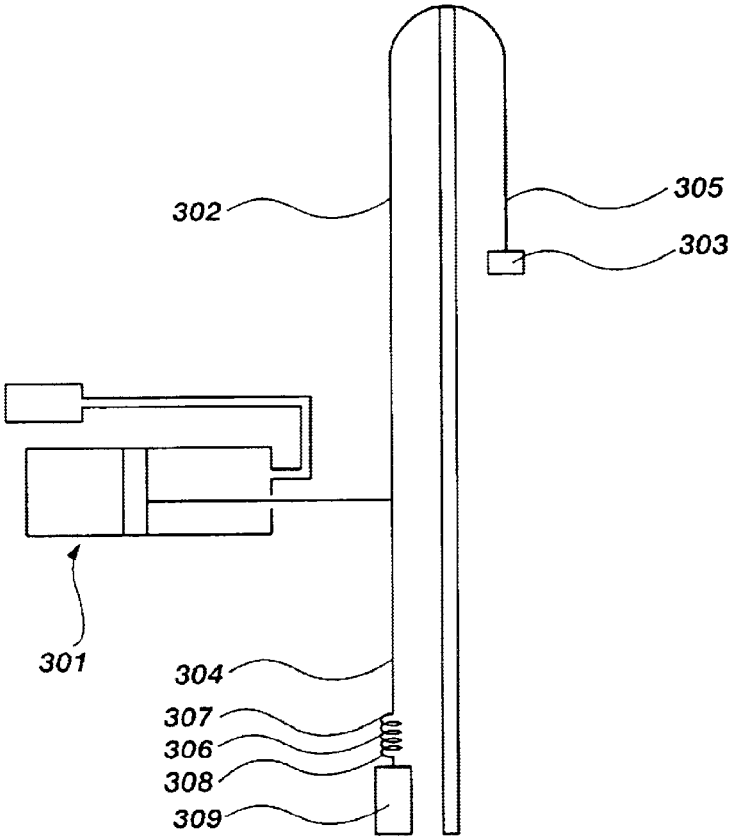
FIG. 14 depicts a spring used at the end of a cable to reduce slackness.
Figure 15:
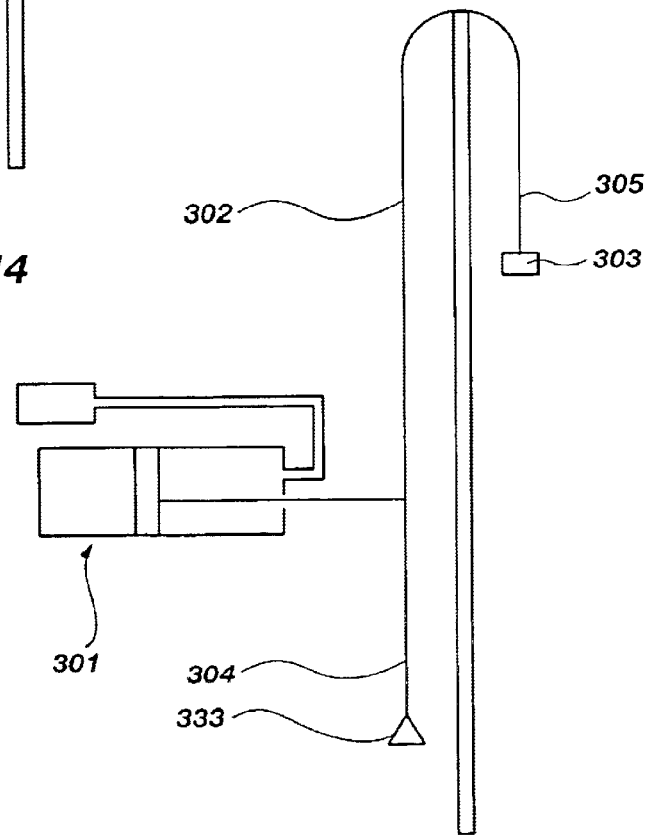
FIG. 15 shows a weight attached to the end of a cable to reduce slackness.
Figure 16:
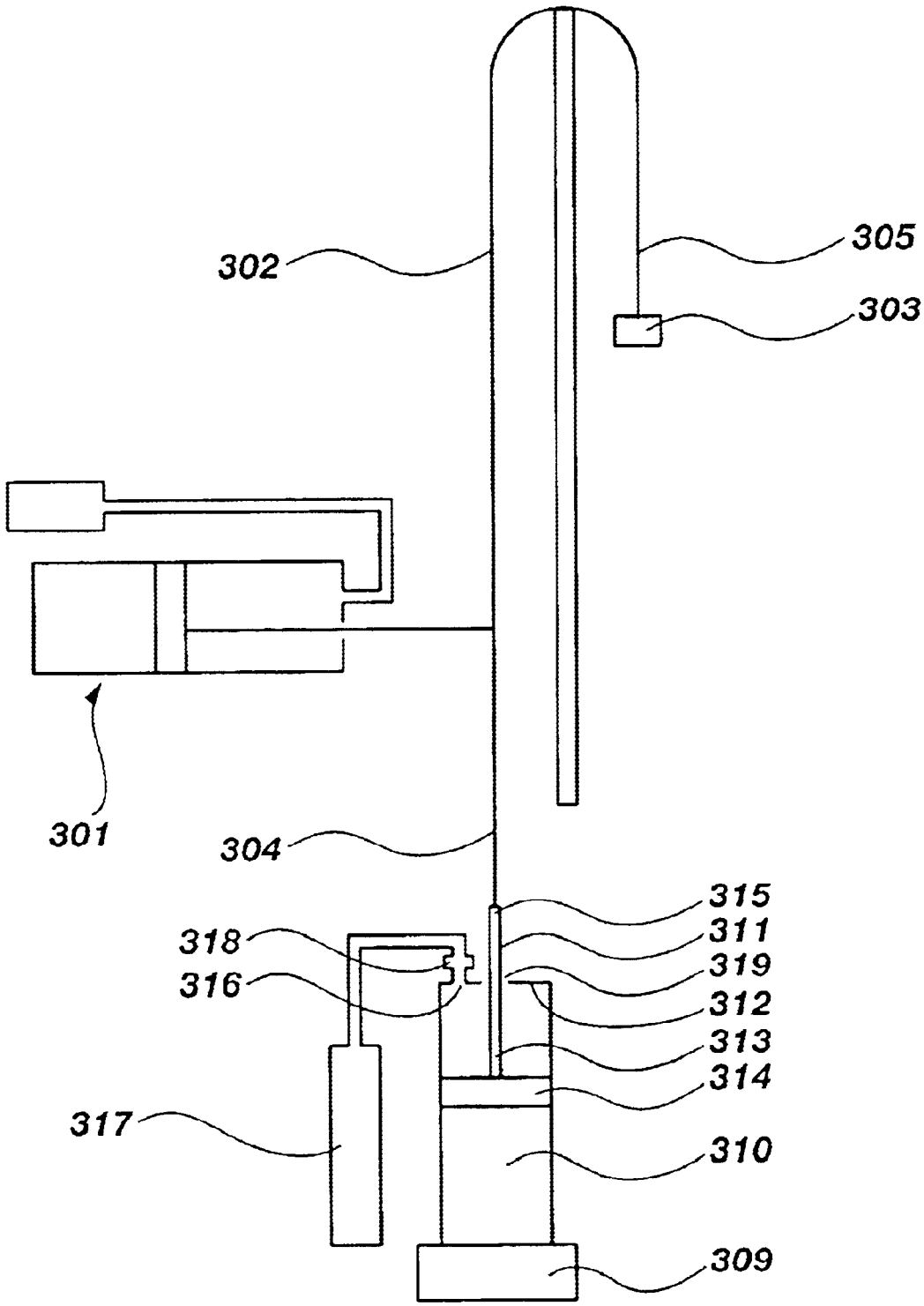
FIG. 16 illustrates a cylinder connected to the end of a cable to reduce slackness.

Examples of devices which can create the pulling force are a spring 306 having a first end 307 connected to the first end 304 of the cable 302 and a second end 308 connected to an object 309 which is so heavy that movement of the carrier 303 will not appreciably move the object 309, as illustrated in FIG. 14; a weight suspended from the first end 304 of the cable, as shown in FIG. 15; and a pressurizable cylinder 310 connected to the object 309 and having a rod 311 extending through an end 312 of the cylinder 310 with the first end 313 of the rod 311 attached to a piston 314 slidably mounted within the cylinder 310 and the second end 315 of the rod 311 attached to the first end 304 of the cable 302, as portrayed in FIG. 16. Alternatively, the rod 311 can be eliminated; and the cable 302 is then connected directly to the piston 314. The object 309 is preferably the earth or a structure attached to the earth. The pressurizable cylinder 310 has an aperture 316 connected to a source 317 of compressed fluid, preferably a gas, through a pressure regulator 318; such aperture 316 is preferably near the end of the pressurizable cylinder 310 through which the rod 311 extends. Also, an aperture 319 exists in the end 312 of the cylinder to allow the rod 311 or cable 302 to pass through the end 312.

Of the various devices, the pressurizable cylinder 310 is preferred.

In order to reduce slackness in the cable 302 when the propulsive force for the carrier 303 is applied at the first end 304 of the cable 302, a means for applying a force substantially transverse to the cable 302 at an intermediate point of the cable 302 is utilized.

Figure 17:
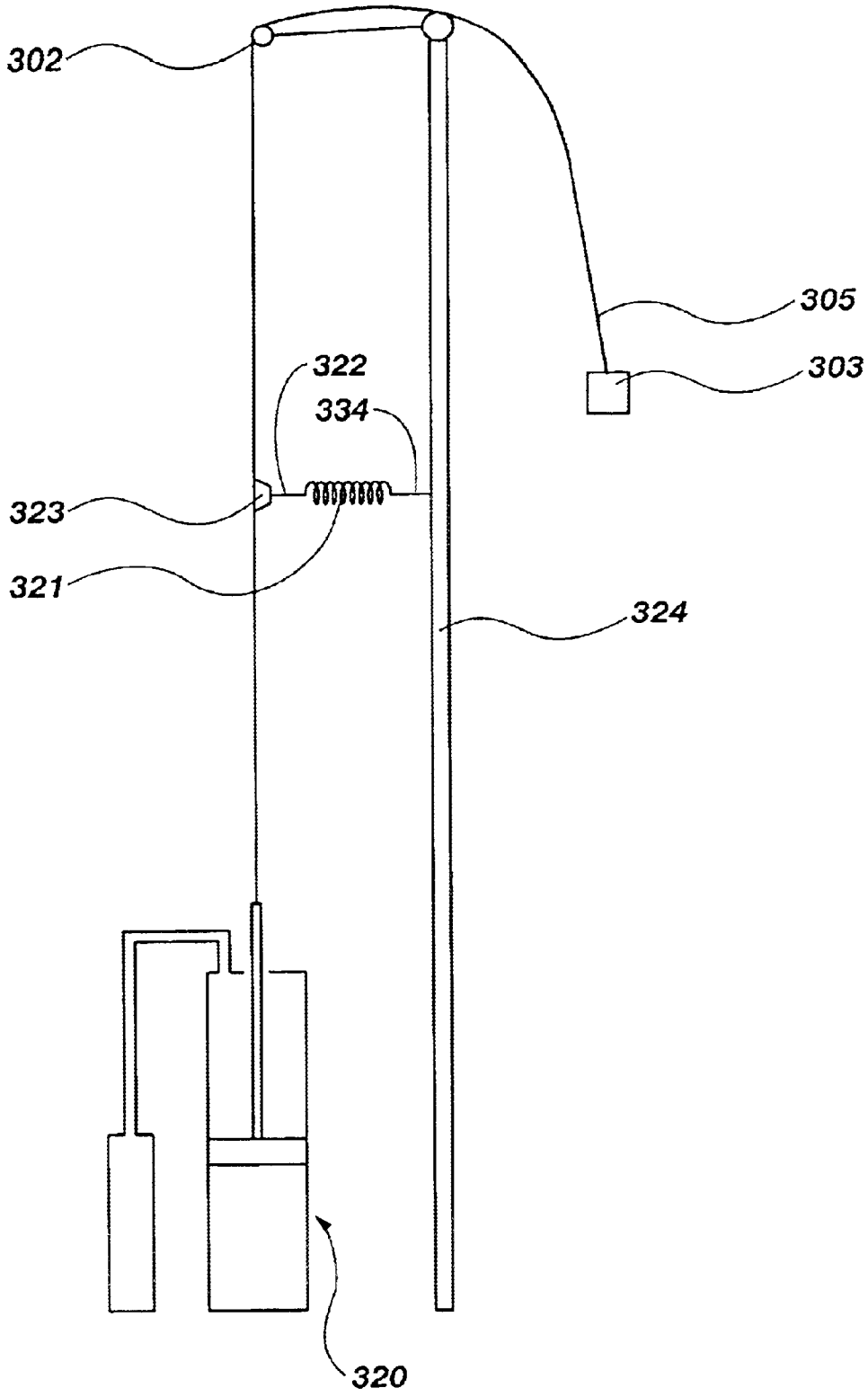
FIG. 17 portrays a spring used at an intermediate point of a cable to reduce slackness.

One example of such a means is, as shown in FIG. 17, a spring 321 having a first end 322 attached to a slide 323 through which the cable 302 can substantially freely move and a second end 323 attached to a rigid structure 324, which could, for example, be a tower 401 from which the cable 302 is supported. The slide 323 can, but need not, totally encircle the cable 302; it is sufficient that the slide 323 goes far enough around the cable 302 to prevent the cable 302 from slipping away from the slide 323.

Figure 18:
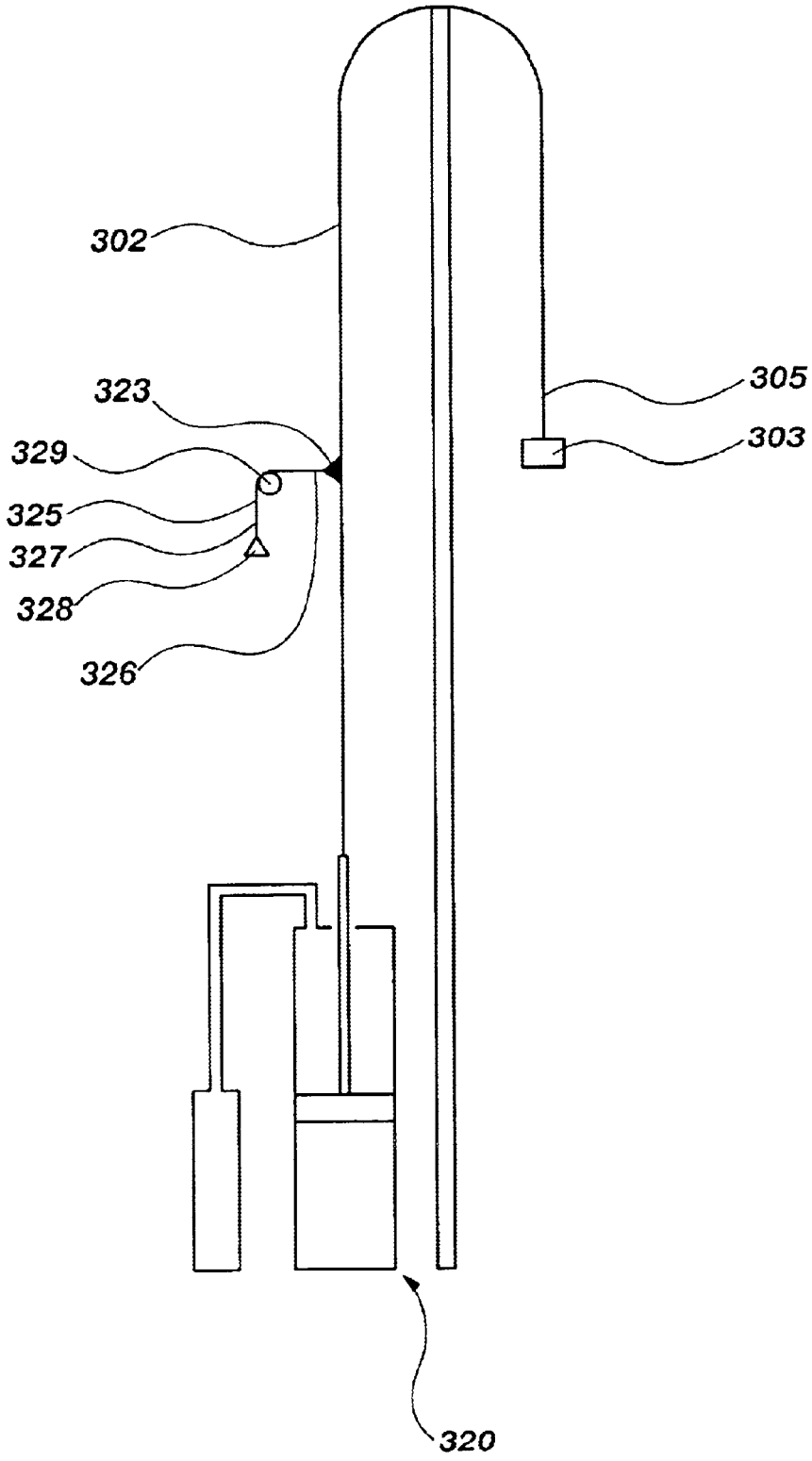
FIG. 18 demonstrates a weight used at an intermediate point of a cable to reduce slackness.

Another example of a means for applying the substantially transverse force is, as illustrated in FIG. 18, a line 325 that has a first end 326 attached to the slide 323 and a second end 327 connected to a weight 328 with the line 325 passing at an intermediate point between the ends 326, 327 around a substantially horizontal structure 329, which is preferably a pulley, to suspend the weight 328.

Figure 19:
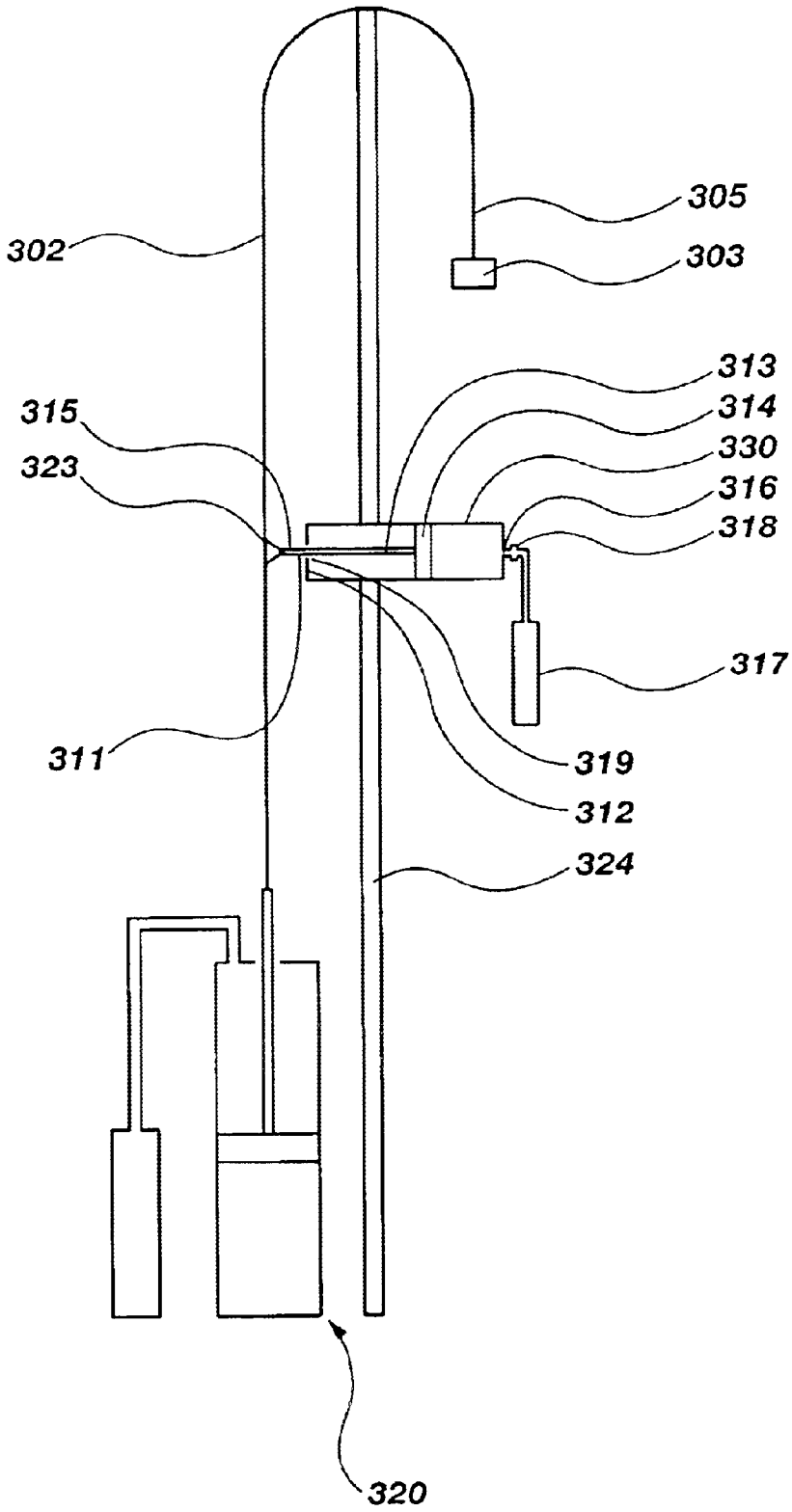
FIG. 19 shows a cylinder pushing against a cable at an intermediate point to reduce slackness.

A third example of a means for applying the substantially transverse force is, as depicted in FIG. 19, a pressurizable cylinder 330 connected to the rigid structure 324 and having a rod 311 extending through an end 312 of the cylinder 330 with the first end 313 of the rod 311 attached to a piston 314 slidably mounted within the cylinder 330 and the second end 315 of the rod 311 attached to the slide 323. The cylinder 330 is constructed just as is the cylinder 310 except that aperture 316 is preferably near the end of the pressurizable cylinder 330 opposite to the end 312 through which the rod 311 extends because it is desired to have the gas exert a force which tends to push the rod 311 from the cylinder 330 rather than tending to pull the rod 311 into the cylinder 330.

Figure 20:
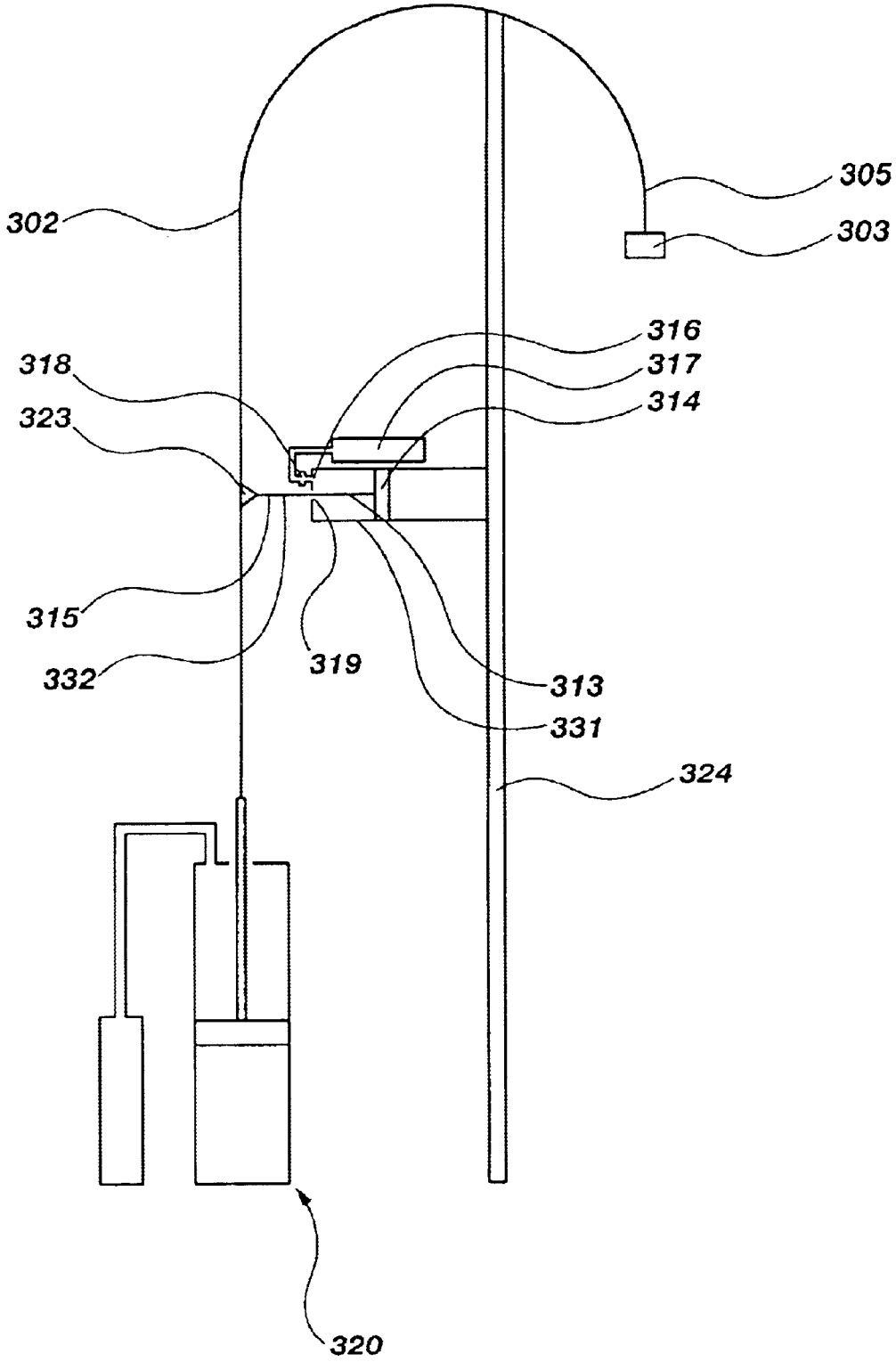
FIG. 20 illustrates a cylinder pulling against a cable at an intermediate point to reduce slackness.
Figure 21:
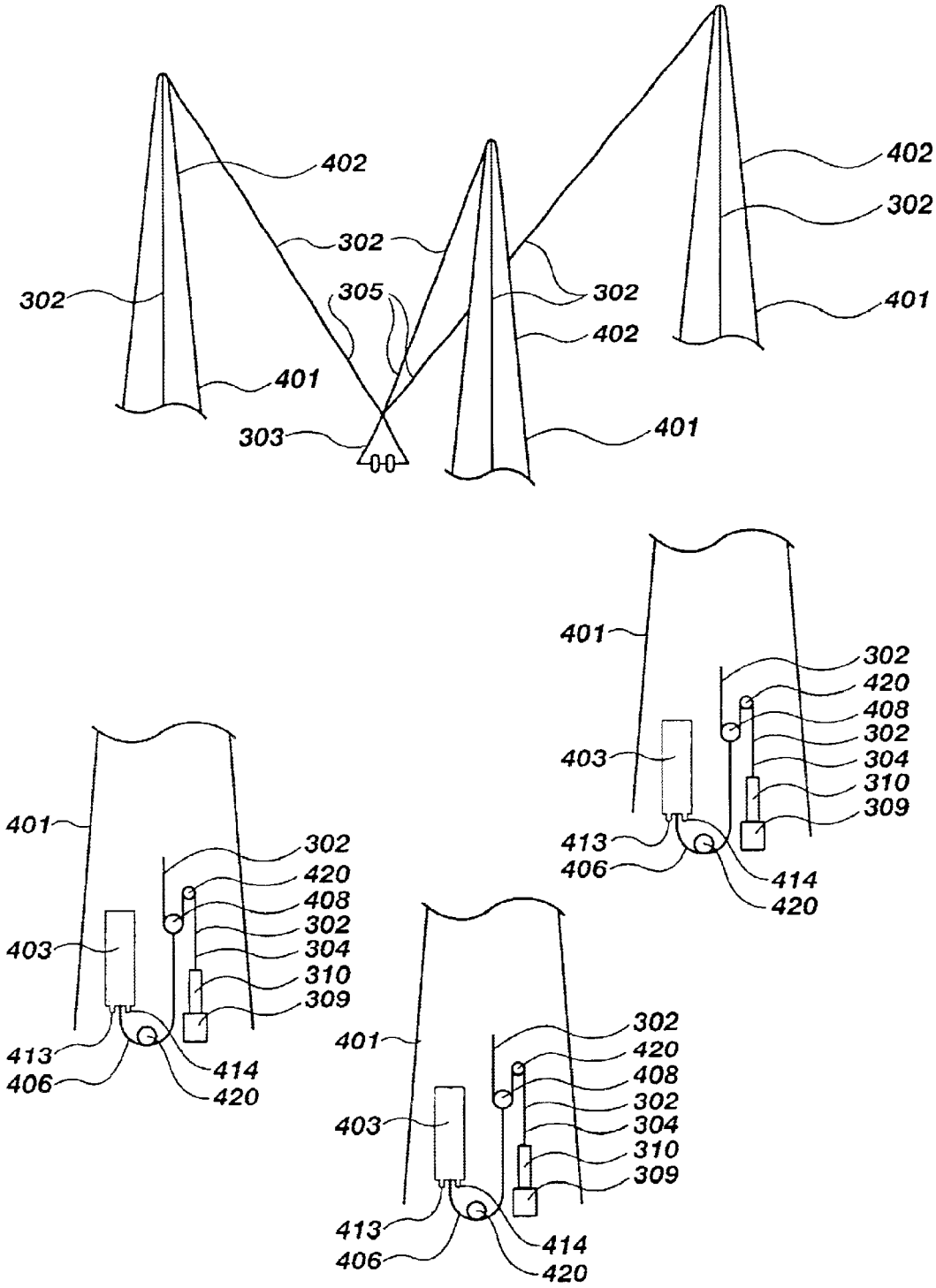
FIG. 21 shows The Amusement Ride with Cable-launched Carrier having a fluid-powered cylinder with a non-continuous cable connected, oriented with the valve for supplying fluid downward, connected at an intermediate point of the cable which has a pressurizable cylinder connected to the first end of said cable.

Still another example of a means for applying the substantially transverse force is portrayed in FIG. 20. A pressurizable cylinder 331 is connected to the rigid structure 324, has a force transferring device 332, either a rod or cable, with the first end 313 of the force transferring device 332 attached to the piston 314, and has the second end 315 of the force transferring device 332 connected to the slide 323. In all other respects the pressurizable cylinder is the same as pressurizable cylinder 310.

As is evident from the preceding discussion, in any embodiment the primary function of each tower 401 is suspending a cable 302 attached to a carrier 303 to permit the carrier 303 and one or more participants to be propelled in a desired direction. The flexibility of at least the upper portion 402 of at least one tower 401 cushions the forces on the carrier 303 and, consequently, on participants in the carrier 303. One skilled in the art will, however, understand that, in an amusement ride, such cushioning is subsidiary to acceleration of the carrier 303 and the participants. Thus, one skilled in the art will also recognize that each tower 401 must be adequately rigid to permit the desired acceleration of the carrier 303 and participants. Although some movement of a tower 401 when an accelerative force is applied to the carrier 303 will, in accordance with well-understood principles of physics, reduce the force applied to the carrier, one skilled in the art will recognize that such movement must not be so great as to detract from the excitement of the acceleration which is a mainstay of amusement rides. The towers 401 are constructed of any material known in the art, such as steel; and for the purposes of this application, flexibility, thus, means that a tower 401 will move to such an extent as to cushion the accelerative force on the carrier 303 but not so far as to detract from the excitement of such acceleration. At a minimum, not every tower 401 can be absolutely rigid.

The most preferred embodiment of the Amusement Ride with Cable-launched Carrier comprises three towers 401, each tower suspending a cable 302, with at least one of said towers 401 having a flexible upper portion 402; associated with each cable 302, a fluid-powered cylinder 403 having a non-continuous cable, oriented with the valve 413 downward, and connected to the cable 302 at an intermediate point of the cable 302; a transfer cable 406 which is flexible and bends around any device 420 for changing the direction of a physical force without creating substantial friction, such as a pulley, so that the transfer cable 406 travels upward before connecting to the slide 408 around the cable 302 in order, as described above, to connect a fluid-powered cylinder 403 to each cable 302; a pressurizable cylinder 310 connected to the first end 304 of each cable 302 and to the object 309 as the means for applying a pulling force along the cable 302 in the direction away from the carrier 303 to which the cable 302 is attached, with the object 309 located horizontally near the device 420; for each cable 320, another device 420 around which the cable 302 passes between the slide 408 and the first end 304 of the cable 302; and a carrier 303 connected to the second end of each cable 302.

I claim:

1. An amusement ride with cable-launched carrier which comprises:

one or more towers with at least one of said towers having a flexible upper portion;

a cable suspended from each tower, said cable having a first end and a second end;

a carrier for one or more participants attached to the second end of said cable;

a means for propelling said carrier, said means for propelling being attached to said cable other than at the second end of said cable; and a controllably rotatable seat attached to said carrier.

2. The amusement ride with cable-launched carrier as recited in claim 1, further comprising:

a harness attached to a locking apparatus connected to said carrier.

3. The amusement ride with cable-launched carrier as recited in claim 2, further comprising:

a device for maintaining tension in said cable attached to said cable.

4. The amusement ride with cable-launched carrier as recited in claim 1, further comprising:

a device for maintaining tension in said cable attached to said cable.

5. An amusement ride with cable-launched carrier which comprises:

one or more towers with at least one of said towers having a flexible upper portion;

a cable suspended from each tower, said cable having a first end and a second end;

a carrier for one or more participants attached to the second end of said cable;

a high-speed winch for propelling said carrier, said high-speed winch being attached to said cable other than at the second end of said cable; and a controllably rotatable seat attached to said carrier.

6. The amusement ride with cable-launched carrier as recited in claim 5, further comprising:

a harness attached to a locking apparatus connected to said carrier.

7. The amusement ride with cable-launched carrier as recited in claim 6, further comprising:

a device for maintaining tension in said cable attached to said cable.

8. The amusement ride with cable-launched carrier as recited in claim 5, further comprising:

a device for maintaining tension in said cable attached to said cable.

9. An amusement ride with cable-launched carrier which comprises:

one or more towers with at least one of said towers having a flexible upper portion;

a cable suspended from each tower, said cable having a first end and a second end;

a carrier for one or more participants attached to the second end of said cable;

a fluid-powered cylinder for propelling said carrier, which comprises:

a cylinder having an aperture in a first end and an aperture in a second end of said cylinder and also having a side and an interior;

a piston slidably mounted within said cylinder;

a continuous cable, said continuous cable passing through the aperture in the first end of the cylinder and the aperture in the second end of the cylinder, said continuous cable being attached to said piston, and said continuous cable being attached to said cable other than at the second end of said cable; and a valve for injecting the fluid to propel the piston, said valve being near the first end of said cylinder; and a controllably rotatable seat attached to said carrier.

10. The amusement ride with cable-launched carrier as recited in claim 9, further comprising:

a harness attached to a locking apparatus connected to said carrier.

11. The amusement ride with cable-launched carrier as recited in claim 10, further comprising:

a device for maintaining tension in said cable attached to said cable.

12. The amusement ride with cable-launched carrier as recited in claim 11, further comprising:

a descent valve communicating with the interior of said cylinder.

13. The amusement ride with cable-launched carrier as recited in claim 12, further comprising:

an aperture in the side of said cylinder.

14. The amusement ride with cable-launched carrier as recited in claim 11, further comprising:

an aperture in the side of said cylinder.

15. The amusement ride with cable-launched carrier as recited in claim 10, further comprising:

a descent valve communicating with the interior of said cylinder.

16. The amusement ride with cable-launched carrier as recited in claim 15, further comprising:

an aperture in the side of said cylinder.

17. The amusement ride with cable-launched carrier as recited in claim 10, further comprising:

an aperture in the side of said cylinder.

18. The amusement ride with cable-launched carrier as recited in claim 9, further comprising:

a device for maintaining tension in said cable attached to said cable.

19. The amusement ride with cable-launched carrier as recited in claim 18, further comprising:

a descent valve communicating with the interior of said cylinder.

20. The amusement ride with cable-launched carrier as recited in claim 19, further comprising:

an aperture in the side of said cylinder.

21. The amusement ride with cable-launched carrier as recited in claim 18, further comprising:

an aperture in the side of said cylinder.

22. The amusement ride with cable-launched carrier as recited in claim 9, further comprising:

a descent valve communicating with the interior of said cylinder.

23. The amusement ride with cable-launched carrier as recited in claim 22, further comprising:

an aperture in the side of said cylinder.

24. The amusement ride with cable-launched carrier as recited in claim 9, further comprising:

an aperture in the side of said cylinder.

25. An amusement ride with cable-launched carrier which comprises:

one or more towers with at least one of said towers having a flexible upper portion;

a cable suspended from each tower, said cable having a first end and a second end;

a carrier for one or more participants attached to the second end of said cable;

a fluid-powered cylinder for propelling said carrier, which comprises:

a cylinder having an aperture in a first end and an aperture in a second end of said cylinder and also having a side and an interior;

a piston slidably mounted within said cylinder;

a continuous cable, said continuous cable passing through the aperture in the first end of the cylinder and the aperture in the second end of the cylinder and said continuous cable being attached to said piston; and a valve for injecting the fluid to propel the piston, said valve being near the first end of said cylinder;

a slide through which said cable moves substantially freely; and a transfer cable having a first end connected to said continuous cable and a second end connected to said slide; and wherein:

the first end of said cable is attached to a structure which will hold the first end of said cable substantially stationary.

26. An amusement ride with cable-launched carrier which comprises:

one or more towers with at least one of said towers having a flexible upper portion;

a cable suspended from each tower, said cable having a first end and a second end;

a carrier for one or more participants attached to the second end of said cable;

a fluid-powered cylinder for propelling said carrier, which comprises:

a cylinder having an aperture in a first end and also having a side and an interior;

a piston slidably mounted within said cylinder and attached to said cable other than at the second end of said cable; and a valve for injecting the fluid to propel the piston, said valve being near the first end of said cylinder; and a controllably rotatable seat attached to said carrier.

27. The amusement ride with cable-launched carrier as recited in claim 26, further comprising:

a harness attached to a locking apparatus connected to said carrier.

28. The amusement ride with cable-launched carrier as recited in claim 27, further comprising:

a device for maintaining tension in said cable attached to said cable.

29. The amusement ride with cable-launched carrier as recited in claim 28, further comprising:

a descent valve communicating with the interior of said cylinder.

30. The amusement ride with cable-launched carrier as recited in claim 29, further comprising:

an aperture in the side of said cylinder.

31. The amusement ride with cable-launched carrier as recited in claim 28, further comprising:

an aperture in the side of said cylinder.

32. The amusement ride with cable-launched carrier as recited in claim 27, further comprising:

a descent valve communicating with the interior of said cylinder.

33. The amusement ride with cable-launched carrier as recited in claim 32, further comprising:

an aperture in the side of said cylinder.

34. The amusement ride with cable-launched carrier as recited in claim 27, further comprising:

an aperture in the side of said cylinder.

35. The amusement ride with cable-launched carrier as recited in claim 26, further comprising:

a device for maintaining tension in said cable attached to said cable.

36. The amusement ride with cable-launched carrier as recited in claim 35, further comprising:

a descent valve communicating with the interior of said cylinder.

37. The amusement ride with cable-launched carrier as recited in claim 36, further comprising:

an aperture in the side of said cylinder.

38. The amusement ride with cable-launched carrier as recited in claim 35, further comprising:

an aperture in the side of said cylinder.

39. The amusement ride with cable-launched carrier as recited in claim 26, further comprising:

a descent valve communicating with the interior of said cylinder.

40. The amusement ride with cable-launched carrier as recited in claim 39, further comprising:

an aperture in the side of said cylinder.

41. The amusement ride with cable-launched carrier as recited in claim 26, further comprising:

an aperture in the side of said cylinder.

42. An amusement ride with cable-launched carrier which comprises:

one or more towers with at least one of said towers having a flexible upper portion;

a cable suspended from each tower, said cable having a first end and a second end;

a carrier for one or more participants attached to the second end of said cable;

a fluid-powered cylinder for propelling said carrier, which comprises:

a cylinder having an aperture in a first end and also having a side and an interior;

a piston slidably mounted within said cylinder and available for connection to a cable; and a valve for injecting the fluid to propel the piston, said valve being near the first end of said cylinder;

a slide through which said cable moves substantially freely; and a transfer cable having a first end connected to said piston and a second end connected to said slide; and wherein:

the first end of said cable is attached to a structure which will hold the first end of said cable substantially stationary.

43. An amusement ride with cable-launched carrier, which comprises:

three towers with at least one of said towers having a flexible upper portion;

a cable suspended from each tower, each of said cables having a first end and a second end;

a carrier for one or more participants attached to the second ends of said cables;

a fluid-powered cylinder, comprising:

a cylinder having an aperture in a first end and also having a side and an interior;

a piston slidably mounted within said cylinder and available for connection to a cable; and a valve for injecting the fluid to propel the piston, said valve being near the first end of said cylinder, wherein said cylinder is oriented with the valve downward;

a slide through which said cable moves substantially freely;

a transfer cable having a first end connected to said piston and a second end connected to said slide;

a pulley around which the transfer cable bends between said cylinder and said slide so that said transfer cable travels upward before connecting to said slide;

another pulley around which said cable passes between said slide and the first end of said cable;

a controllably rotatable seat attached to said carrier;

a harness attached to a locking apparatus connected to said carrier;

a pressurizable cylinder connected to an object which is so heavy that movement of the carrier will not appreciably move the object, said pressurizable cylinder having a piston slidably mounted within the cylinder and attached to the first end of said cable, said pressurizable cylinder also having an aperture for connection to a source of compressed fluid near an end of said cylinder, and said pressurizable cylinder having an aperture in that end of the pressurizable cylinder to allow said cable to pass through the end of the pressurizable cylinder;

a descent valve communicating with the interior of said cylinder;

an aperture in the side of said cylinder; and wherein:

the first end of said cable is attached to a structure which will hold the first end of said cable substantially stationary.

* * * * *